US005127580A

United States Patent [19]

Fu-I

[11] Patent Number: 5,127,580

[45] Date of Patent: Jul. 7, 1992

[54] SHOWER HEAD ASSEMBLY

[76] Inventor: Liu Fu-I, 4Fl.-1, No. 49-1, Sec. 2, Hoping E. Rd., Taipei, Taiwan

[21] Appl. No.: 732,607

[22] Filed: Jul. 19, 1991

[51] Int. Cl.[5] ..... B05B 1/16; B05B 1/18

[52] U.S. Cl. ..... 239/447; 239/449; 239/525; 239/581.1

[58] Field of Search ..... 239/446, 447, 448, 449, 239/525, 581.1

[56] References Cited

U.S. PATENT DOCUMENTS

| | | | |
|---|---|---|---|
| 166,654 | 8/1875 | Thomson | 239/449 |
| 236,541 | 1/1881 | Broughton | 239/449 |
| 2,567,176 | 9/1951 | Ballard | 239/449 |
| 2,567,642 | 9/1951 | Henshaw | 239/449 |
| 4,618,100 | 10/1986 | White et al. | 239/447 X |
| 4,674,687 | 6/1987 | Smith et al. | 239/449 X |
| 4,754,928 | 7/1988 | Rodgers et al. | 239/447 X |
| 5,033,897 | 7/1991 | Chen | 239/449 X |

*Primary Examiner*—Andres Kashnikow
*Assistant Examiner*—William Grant
*Attorney, Agent, or Firm*—Marger, Johnson, McCollom & Stolowitz

[57] ABSTRACT

A shower head assembly includes a handle, a housing rotatably engages with the handle, and an output member received in the housing. The handle has a water supply end from which a block protrudes. Two water supply holes are formed on the block. The housing includes a first portion defining a first chamber therein for receiving the water output end of the handle, a second portion defining a second chamber therein for receiving the output member, and a mediate portion connecting the first and second portions. Two first water passages and two second water passages are formed in the mediate portion. The output member has a central output in fluid communication with the second water passages and a plurality of fine peripheral apertures in fluid communication with the first water passages. The first water passages are in fluid communication with the water supply holes and the second water passages are not in fluid communication with the water supply holes when the rotatable housing is in a first position. The first water passages are not in fluid communication with the water supply holes and the second water passages are in fluid communication with the water supply holes when the rotatable housing is in a second position. And the first and second water passages are both in partial fluid communication with the water supply holes when the rotatable housing is between the first and second positions.

8 Claims, 7 Drawing Sheets

SHOWER HEAD ASSEMBLY

BACKGROUND OF THE INVENTION

The present invention relates to an improved shower head assembly which is adjustable to provide streams of various types, and more particularly to an improved shower head assembly which outputs water streams sufficiently strong to provide a massaging function.

In conventional shower heads, the water stream, after exiting the output(s), rarely supplies a massaging function, and there is a tendency for people today to relax by massaging the body while taking a shower. The present invention proposes an improved shower head assembly which provides a massaging function for relieving stress.

SUMMARY OF THE INVENTION

A shower head assembly according to the present invention comprises a handle, a housing rotatably engaged with the handle, and an output means received in the housing. The handle has a water supply end from which a block protrudes. Two water supply holes are formed on the block. The housing includes a first portion defining a first chamber therein for receiving the water output end of the handle, a second portion defining a second chamber therein for receiving the output means, and a mediate portion connecting the first and second portions. Two first water passages and two second water passages are formed in the mediate portion.

The output means has a central output in fluid communication with the second water passages and a plurality of fine peripheral apertures in fluid communication with the first water passages. The first water passages are in fluid communication with the water supply holes and the second water passages are not in fluid communication with the water supply holes when the rotatable housing is in a first position. Conversely, the first water passages are not in fluid communication with the water supply holes and the second water passages are in fluid communication with the water supply holes when the rotatable housing is in a second position. And the first and second water passages are both in partial fluid communication with the water supply holes when the rotatable housing is between the first and second positions.

The second water passages meet at a position before the central hole, so that the water from the water supply holes combines to form a single intense stream, which immediately outputs via the central hole, providing a massaging function.

It is a primary object of the present invention to provide an improved shower head assembly in which the outputted water stream provides an adjustable massaging effect.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
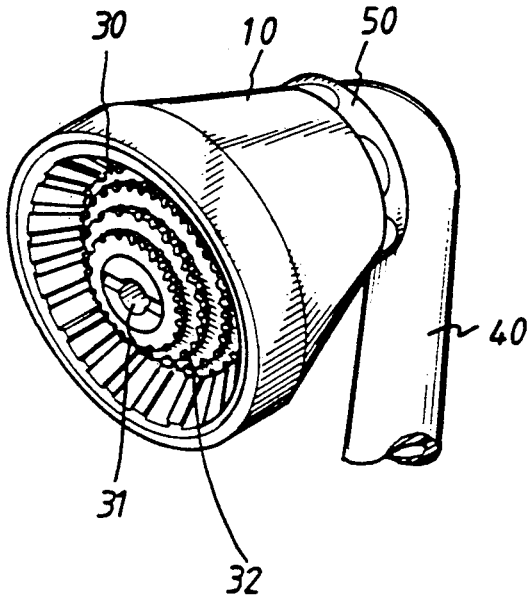
FIG. 1 is a perspective view of an improved shower head assembly according to the present invention.
Figure 2:
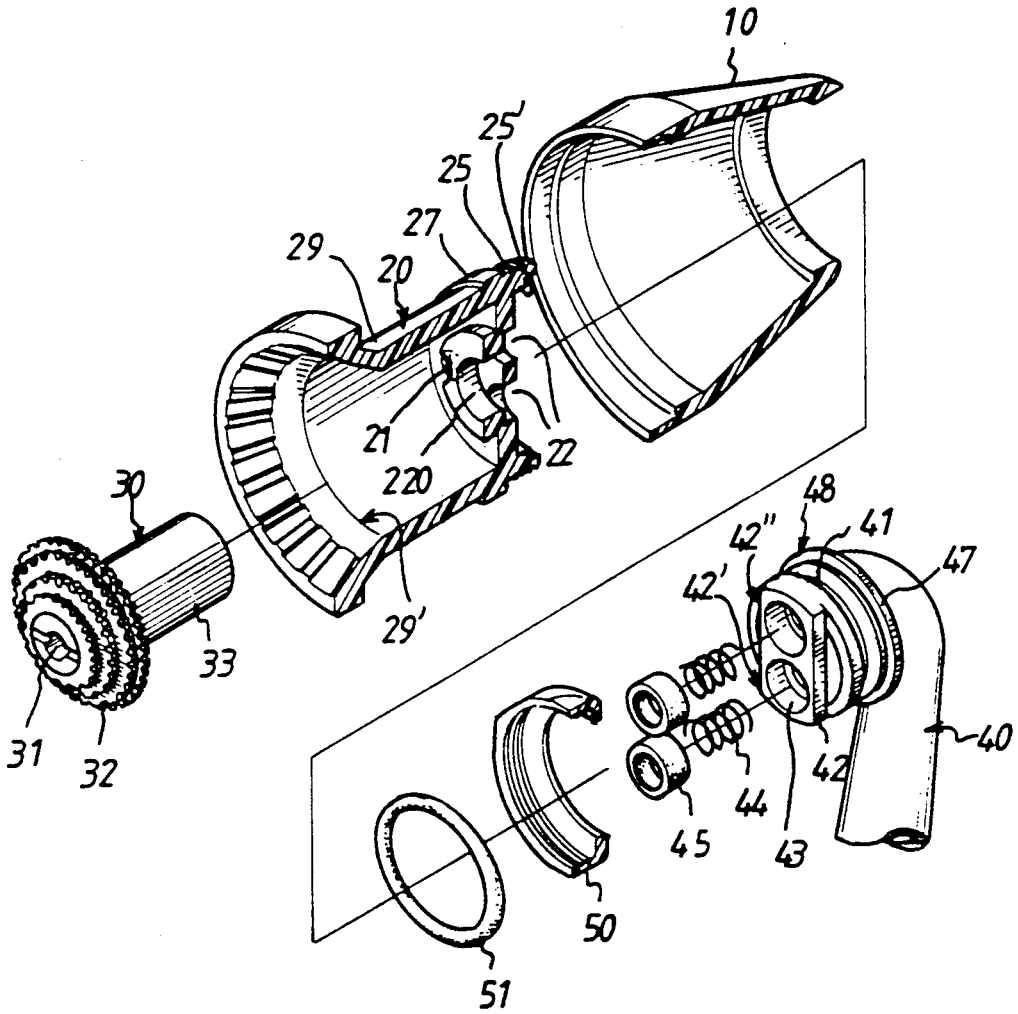
FIG. 2 is an exploded perspective view of the improved shower head assembly according to the present invention.

Referring now to the drawings and initially to FIGS. 1 and 2, a shower head assembly according to the present invention includes a handle 40 and a housing 20 rotatably mounted to the handle 40. The handle 40 has a water supply end 48 from which a block 42 protrudes. Two water supply holes 43 are formed on the block 42 for supplying water from a water source (not shown) via an inner passage in the handle 40.

Figure 3:
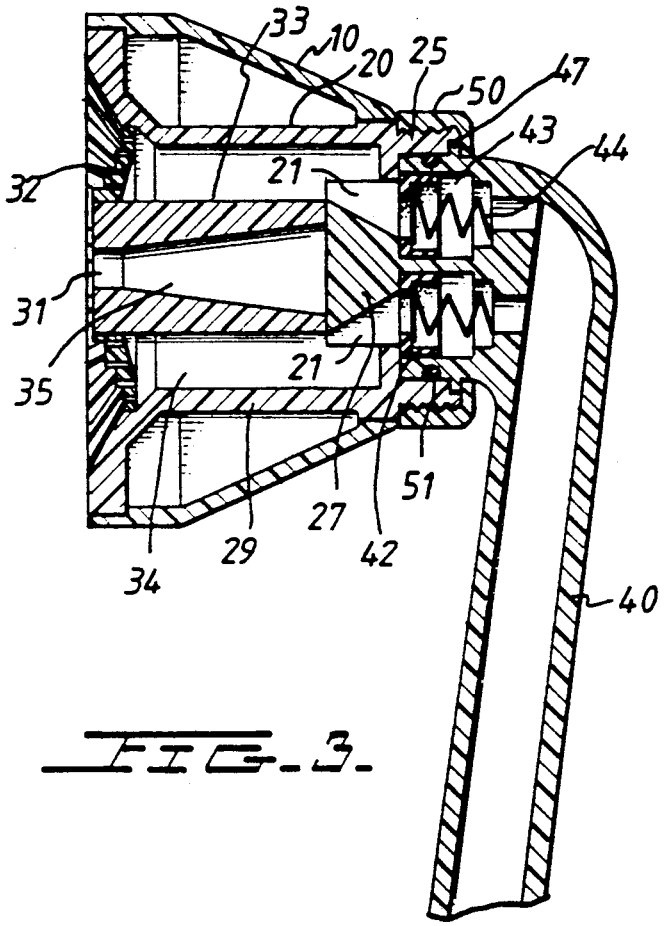
FIG. 3 is a cross-sectional view of the improved shower head assembly in which the water supply holes of the handle are in fluid communication with the fine peripheral apertures of the output means via the first water passages.
Figure 4:
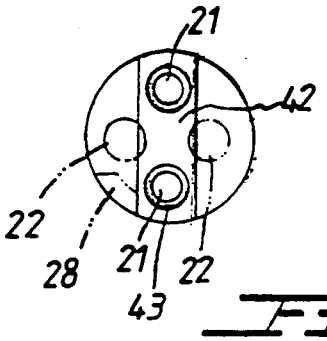
FIG. 4 is a schematic plan view according to FIG. 3 showing alignment between the water supply holes of the handle and the first water passages which are in fluid communication with the fine peripheral apertures of the output means.

The rotatable housing 20 includes a first portion 25 defining a first chamber 25' therein, a second portion 29 defining a second chamber 29' therein, and a mediate portion 27 connecting the first and second portions 25 and 29. Referring to FIG. 3, the first chamber 25' receives the block 42 so that the housing 20 rotatably engages with the water supply end 48 of the handle 40. Still referring to FIG. 3, and further to FIGS. 4 and 10, two first water passages 21 and two second water passages 22 are alternatively formed in the mediate portion 27, which will be discussed later. A gasket 51 is provided between an inner peripheral wall of the first portion 25 and an outer preventing water leakage therethrough. In this embodiment, an annular groove 41 is formed on the outer periphery of the water supply end 48 for receiving the gasket 51 (cf. FIG. 2). A flange 47 is formed on the outer wall of the water supply end 48. The outer peripheral wall of the first portion 25 is threaded, and a cap 50 with inner threading is provided to securely fasten the rotatable housing 20 and the handle 40 together, with the inner peripheral wall of the first portion 25 against the flange 47, and without affecting rotational movement of the rotatable housing 20 relative to the handle 40 (i.e., the cap 50 rotates with the housing 20).

An output means 30 is received in the second chamber 29'. The output means 30 has a cylindrical portion 33 with an inner passage 35, a central output 31 in fluid communication with the second water passages 22 via the inner passage 35, and a plurality of fine peripheral apertures 32 in fluid communication with the first water passages 21 via a space 34 between an outer periphery of the cylindrical portion 33 and an inner peripheral wall of the second portion 29.

Figure 5:
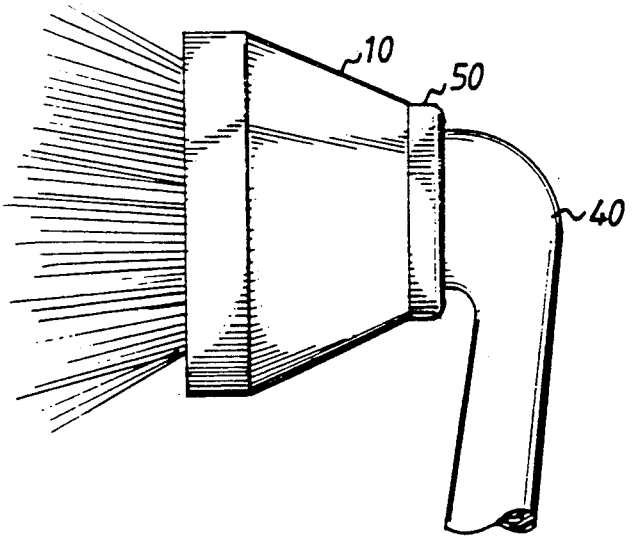
FIG. 5 is a schematic side view showing water outputted by the shower head assembly which is in a status shown by FIG. 3.
Figure 10:
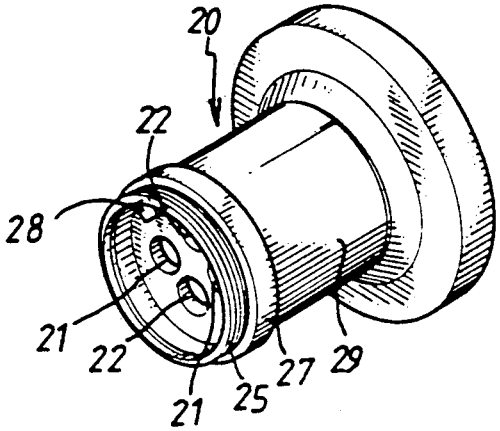
FIG. 10 is a rear perspective view of a housing of the shower head assembly according to the present invention.

Referring to FIG. 10, a stop 28 is provided on the inner peripheral wall of the first portion 25 without interrupting water flowing into the first and second water passages 21 and 22. When the rotatable housing 20 is in a first position shown in FIG. 3, i.e., the stop 28 abuts a lower end 42' of a left side of the block 42 (cf. FIG. 4), the first water passages 21 are in fluid communication with the water supply holes 43 and the second water passages 22 are not in fluid communication with the water supply holes 43. Accordingly, water from the water output end 48 passes through the water supply holes 43, the first water passages 21, the space 34, and then outputs via the fine peripheral apertures 32 of the output means 30 (cf. FIGS. 3 and 5).

Figure 6:
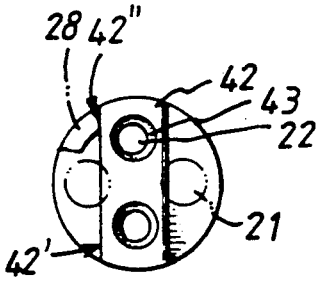
FIG. 6 is a schematic plan view similar to FIG. 4 showing alignment between the water supply holes of the handle and the second water passages which are in fluid communication with the central hole of the output means.
Figure 8:
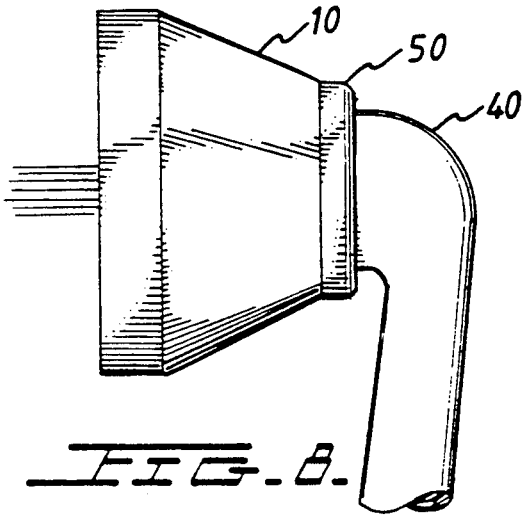
FIG. 8 is a schematic side view showing water outputted by the shower head assembly which is in a status shown by FIG. 7.
Figure 7:
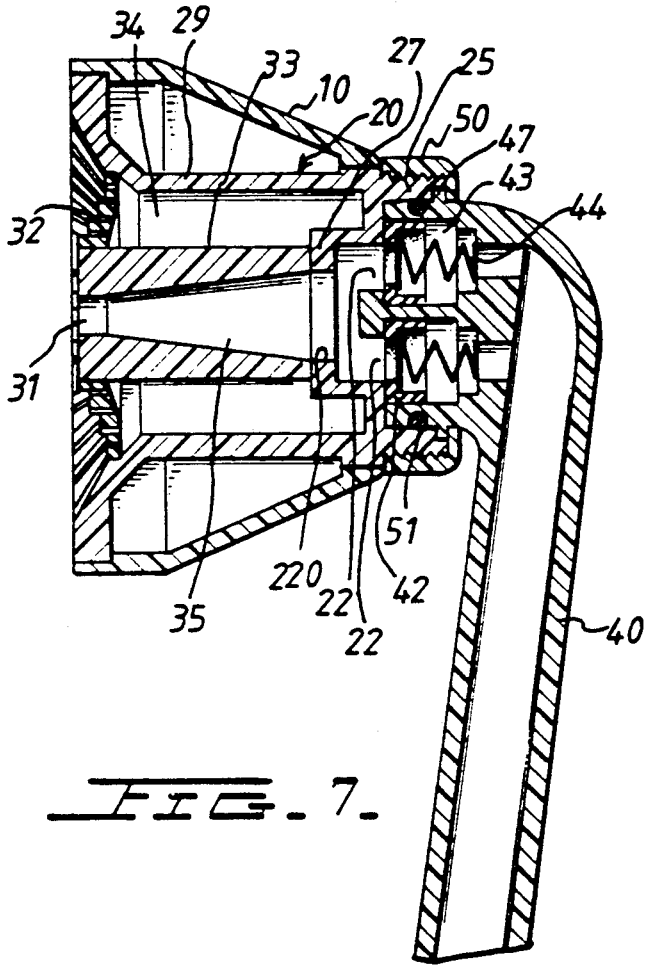
FIG. 7 is a cross-sectional view similar to FIG. 3, in which the water supply holes of the handle are in fluid communication with the central hole of the output means.

When the rotatable housing 20 is in a second position shown in FIG. 7, i.e., the stop 28 abuts an upper end 42" of the left side of the block 42 (under rotation of the whole housing 20, cf. FIG. 6), the first water passages 21 are not in fluid communication with the water supply holes 43 and the second water passages 22 are in fluid communication with the water supply holes 43. Accordingly, water from the water output end 48 passes through the water supply holes 43, the second water passages 22, the inner passage 35, and then outputs via the central hole 31 of the output means 30 (cf. FIGS. 7 and 8).

Figure 9:
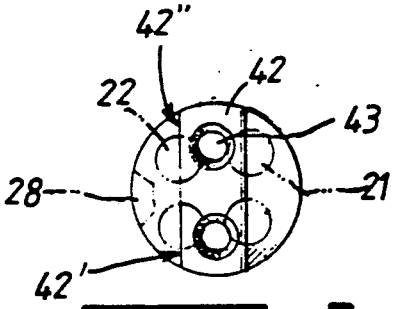
FIG. 9 is a schematic plan view in which both the first and second water passages are in partial fluid communication with the water supply holes.

Referring to FIG. 9, the first and second water passages 21 and 22 are both partially in fluid communication with the water supply holes 43 when the rotatable housing 20 is between the first and second positions. Water outputs partially via the central hole 31 and partially via the fine peripheral apertures 32.

Referring back to FIG. 3, one feature of the present invention is that the second water passages 22 meet at a position before the central hole 31, so that the water from the water supply holes 43 combines to form a single intense stream before the central hole 31, which immediately outputs via the central hole 31. The combined water stream provides a strong vibration effect for massaging. A user may adjust the water stream suitable to himself by rotating the housing 20.

Optionally, the shower head assembly may further have a grasp cone 10 provided therearound so as to be grasped by a hand for gripping. Furthermore, indication marks can be provided on the grasp cone 10 for indicating the first and second positions of the rotatable housing 20. The shower head assembly may further have a seal 45 and a spring 44 received in each of the first and second water passages 21 and 22, such that the spring 44, under compression by water from the water output holes 43, biases the seal 45 to be against the inner wall of the first chamber 25' which faces the water output holes 43, further preventing water leakage between the inner wall and the block 42.

Although the invention has been explained in relation to its preferred embodiment, it is to be understood that many other possible modifications and variations can be made without departing the spirit and scope of the invention as hereinafter claimed.

I claim:

1. A shower head assembly comprising:

a handle having a water supply end from which a block protrudes, a set of water supply holes being formed on said block;

a housing including a first portion defining a first chamber therein, a second portion defining a second chamber therein, and a mediate portion connecting said first and second portions, said first chamber receiving said block so that said housing rotatably engages with said water supply end of said handle, a first set of water passages and a second set of water passages being formed in said mediate portion;

an output means received in said second chamber, said output means having a central output in fluid communication with said second set of water passages and a plurality of peripheral outputs in fluid communication with said first set of water passages;

said first set of water passages being in fluid communication with said water supply holes and said second set of water passages not being in fluid communication with said water supply holes when said rotatable housing is in a first position, said first set of water passages not being in fluid communication with said water supply holes and said second set of water passages being in fluid communication with said water supply holes when said rotatable housing is in a second position, and said first and second sets of water passages both being in partial fluid communication with said water supply holes when said rotatable housing is between said first and second positions.

2. The shower head assembly as claimed in claim 1, wherein said second set of water passages meet at a position before said central hole.

3. The shower head assembly as claimed in claim 1, wherein a stop is formed on an inner peripheral wall of said first chamber for restraining said rotatable housing between said first and second positions under cooperation with said block.

4. The shower head assembly as claimed in claim 1, wherein said output means includes a substantially cylindrical portion received in said second chamber, said cylindrical portion having an inner passage for communicating said central hole with said second set of water passages, an outer periphery of said cylindrical portion and an inner peripheral wall of said second portion of said housing together defining a space for communicating said peripheral outputs with said first set of water passages.

5. The shower head assembly as claimed in claimed 1, wherein a gasket is provided between an inner peripheral wall of said first portion and an outer periphery of said water supply end of said handle.

6. The shower head assembly as claimed in claim 1, further comprising a flange formed on an outer wall of said water supply end, an outer peripheral wall of said first portion being threaded, and a cap with inner threading being provided around said first portion for retaining said rotatable housing on said flange without affecting the rotational movement thereof relative to said handle.

7. The shower head assembly as claimed in claim 1, further comprising a seal and a spring in each of said first and second water passages, said spring being compressed by the water stream from said water supply holes to bias said seal to be against an inner wall of said first chamber for preventing water leakage.

8. The shower head assembly as claimed in claim 1, further comprising a grasp cone provided around said rotatable housing.

* * * * *

UNITED STATES PATENT AND TRADEMARK OFFICE

CERTIFICATE OF CORRECTION

PATENT NO. : 5,127,580

DATED : July 7, 1992

INVENTOR(S) : Liu Fu-I

It is certified that error appears in the above-identified patent and that said Letters Patent is hereby corrected as shown below:

On the title page, item [54] and in col. 1, line 2, the title should read: IMPROVED SHOWER HEAD ASSEMBLY Column 4, line 14, "output" shoudl be "hole";
line 62, "spring" should be "springs";
line 64, "seal" should be "seals".

Signed and Sealed this

Seventh Day of September, 1993

Bruce Lehman

*Attest:*

BRUCE LEHMAN

*Attesting Officer*

*Commissioner of Patents and Trademarks*